US008065097B2

(12) United States Patent
Kato et al.

(10) Patent No.: US 8,065,097 B2
(45) Date of Patent: Nov. 22, 2011

(54) ENERGY USAGE DISPLAY UNIT

(75) Inventors: Keiji Kato, Nagoya (JP); Hideki Kitagawa, Nagoya (JP); Hiroaki Mori, Nagoya (JP); Yukihiro Suzuki, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 0 days.

(21) Appl. No.: 11/937,904

(22) Filed: Nov. 9, 2007

(65) Prior Publication Data

US 2008/0154546 A1 Jun. 26, 2008

(30) Foreign Application Priority Data

Dec. 21, 2006 (JP) ..... 2006-344751

(51) Int. Cl.
*G01R 21/00* (2006.01)

(52) U.S. Cl. ..... 702/60; 702/182

(58) Field of Classification Search ..... 702/60, 702/182; 700/291, 295; 340/870.02
See application file for complete search history.

(56) References Cited

U.S. PATENT DOCUMENTS

| | | | | |
|---|---|---|---|---|
| 4,399,510 | A * | 8/1983 | Hicks | 705/412 |
| 4,508,261 | A | 4/1985 | Blank | |
| 5,694,538 | A * | 12/1997 | Okazaki et al. | 714/15 |
| 6,311,105 | B1 * | 10/2001 | Budike, Jr. | 700/291 |
| 2004/0161227 | A1 | 8/2004 | Baxter | |

FOREIGN PATENT DOCUMENTS

| | | | |
|---|---|---|---|
| DE | 38 42 857 | A1 | 6/1990 |
| JP | 04-043219 | | 2/1992 |
| JP | 05-087403 | | 4/1993 |
| JP | 2000-274809 | A | 10/2000 |
| JP | 2003-279122 | | 10/2003 |
| JP | 2004-294047 | A | 10/2004 |
| JP | 2006-013780 | | 1/2006 |

OTHER PUBLICATIONS

Matty, 'Advanced Energy Management for Home Use', Aug. 1989, IEEE Publication, vol. 35, No. 3, pp. 584-588.*
European Search Report for EP 07 02 2571 dated Apr. 28, 2008 corresponding to U.S. Appl. No. 11/937,904, filed Nov. 9, 2007.
Chinese Office Action for Application No. 200710193309.7 Mailed Dec. 21, 2010.

* cited by examiner

*Primary Examiner* — Eliseo Ramos Feliciano
*Assistant Examiner* — Elias Desta
(74) *Attorney, Agent, or Firm* — Turocy & Watson, LLP

(57) ABSTRACT

An energy usage display unit for displaying energy usage of gas used for a water heater, water used for the water heater or electricity used in housing where the water heater is set. The energy usage display unit includes a clock section; a counting section for counting usage of gas, water or electricity; a memory section for storing a count value of usage counted by the counting section retroactive to past by a predetermined number with a predetermined time unit; a counting control section for writing the count value of usage at predetermined time; a display control section for reading one or both of the count value and a stored value in the memory section to prepare display data of usage; and a display section for displaying usage based on the display data prepared by the display control section.

8 Claims, 8 Drawing Sheets

(※) April, June, September and November is 30 days.
February is 28 days or 29 days.

ENERGY USAGE DISPLAY UNIT

BACKGROUND OF THE INVENTION

1. Field of the Invention

The present invention relates to an energy usage display unit for displaying energy usage such as usage of gas or water service for a water heater or usage of electricity at housing where the water heater is set.

2. Description of the Related Art

Conventionally, there is a known water heater which can display usage of gas or water used for a water heater (Japanese Patent No. 3061215). As shown in a block diagram in FIG. 6, as a configuration for displaying usage of gas and the like, the water heater includes gas amount detecting means 631, water amount detecting means 641, gas amount integrating means 674, water amount integrating means 675, periodic integrating and managing means 673, memory means 677, display means 676, display switching means 678, integrating period setting means 671, clock means 672 and the like.

The gas amount integrating means 674 adds up a gas amount used in a water heater main body (not shown) detected by the gas amount detecting means 631. The water amount integrating means 675 adds up a water amount used in the water heater main body detected by the water amount detecting means 641. The integrating period setting means 671 sets a reference day of integration, and inputs a reference day data 671*a* to the periodic integrating and managing means 673. The clock means 672 has a calendar function, and supplies clock data 672*a* such as month, day, hour, minute to the periodic integrating and managing means 673.

The periodic integrating and managing means 673 compares the reference day data 671*a* with the clock data 672*a*, reads integration results 674*a*, 675*a* of the gas amount integrating means 674 and the water amount integrating means 675 every integration period, stores the integration results 674*a*, 675*a* in the memory means 677 in association with the integration period, generates reset signals 673*a*, 673*b* to clear the integration values of the gas amount integrating means 674 and the water amount integrating means 675, and restarts the integration from zero.

The water heater adds up the gas amount and an water amount used in the water heater main body by means of the gas amount integrating means 674 and the water amount integrating means 675 (hereinafter generally referred to "integrating means 674, 675",) over the integration period which is set by the integrating period setting means 671, and displays the integration results 674*a*, 675*a* using the display means 676. In a case where it is requested to display a past usage by designating year and month from the display switching means 678, corresponding data is read out from the memory means 677 and is displayed on the display means 676.

According to the conventional water heater, if the periodic integrating and managing means 673 outputs the reset signals 673*a*, 673*b* based on the integration period which is set by the integrating period setting means 671, the integrating means 674, 675 adds up usage of gas and water service in accordance with the integration period, and the display means 676 shows the integration results 674*a*, 675*a* in accordance with the integration period. Therefore, in order to change the period unit (month unit or the like) of usage which is displayed on the display means 676, it is necessary to again set the integration period by the integrating period setting means 671, change output timing of the reset signals 673*a*, 673*b* of the periodic integrating and managing means 673, and change the integration periods of the integrating means 674, 675.

In this case, if the integration period is changed, the periodic integrating and managing means 673 outputs the reset signals 673*a*, 673*b* to the integrating means 674, 675, and, clears the integration values of the integrating means 674, 675, and restarts the integration. Therefore, the current usage which is added up by the integrating means 674, 675 is cleared and the usage can not be displayed. Further, the data stored in the memory means 677 has a different integration period from that before the integration period is changed and thus, the past usage can not be displayed either.

The integration period in the periodic integrating and managing means 673 is obtained by the reference day data 671*a* of the integrating period setting means 671 and the time-counting data 672*a* of the clock means 672. Therefore, time of the clock means 672 is changed, the integration period is reduced or increased by the corresponding time before or after the change and thus, the integration period of the periodic integrating and managing means 673 is changed. Therefore, the periodic integrating and managing means 673 outputs the reset signals 673*a*, 673*b* to the integrating means 674, 675 by the change of the integration period caused by the change in time, and the periodic integrating and managing means 673 clears the integration values of the integrating means 674, 675 and restarts the integration. Thus, in this case also, the current usage which is added up by the integrating means 674 and 675 is cleared and the current usage can not be displayed.

SUMMARY OF THE INVENTION

The present invention has been accomplished in view of the above circumstances, and it is an object of the invention to provide an energy usage display unit in which when usage of energy such as gas and water used in a water heater is to be displayed, even if a period unit of the usage to be displayed is changed, the current and past usage can be displayed with the period unit after the period is changed.

According to a first aspect of the invention, there is provided an energy usage display unit for displaying energy usage of gas used for a water heater, water used for the water heater or electricity used in a housing where the water heater is set, comprising:

a clock section for having a clock and calendar function;

a counting section for counting usage of gas, water or electricity;

a memory section for storing a count value of usage counted by the counting section retroactive to past by a predetermined number with a predetermined time unit;

a counting control section for writing the count value of usage from the counting section to the memory section at predetermined time;

a display control section for reading one or both of the count value of the counting section and a stored value in the memory section to prepare display data of usage, in accordance with a period unit required by a user; and a display section for displaying usage based on the display data prepared by the display control section.

Other objects, features and advantages of the present invention will become more fully understood from the detailed description given hereinbelow and the accompanying drawings which are given by way of illustration only, and thus are not to be considered as limiting the present invention.

BRIEF DESCRIPTION OF THE DRAWINGS

FIGS. 4A to 4C are screen diagrams showing examples of display in the display section of the energy usage display unit according to the first embodiment, wherein FIG. 4A is a list display screen of a current usage, FIG. 4B is a comparison display screen between the current usage and a target value, and FIG. 4C is a comparison display screen between the current usage and a past usage;

DETAILED DESCRIPTION OF THE PREFERRED EMBODIMENTS

Embodiments of the present invention will be explained with reference to the accompanying drawings.

First Embodiment

An energy usage display unit according to a first embodiment is applied to a remote control unit 1 which is communication connected to a water heater 2 for remotely operating the water heater 2. The energy usage display unit displays, on the remote control unit 1, usage of gas and water used for the water heater 2 and usage of electricity of an entire housing where the water heater 2 is set (see FIG. 1).

Figure 1:
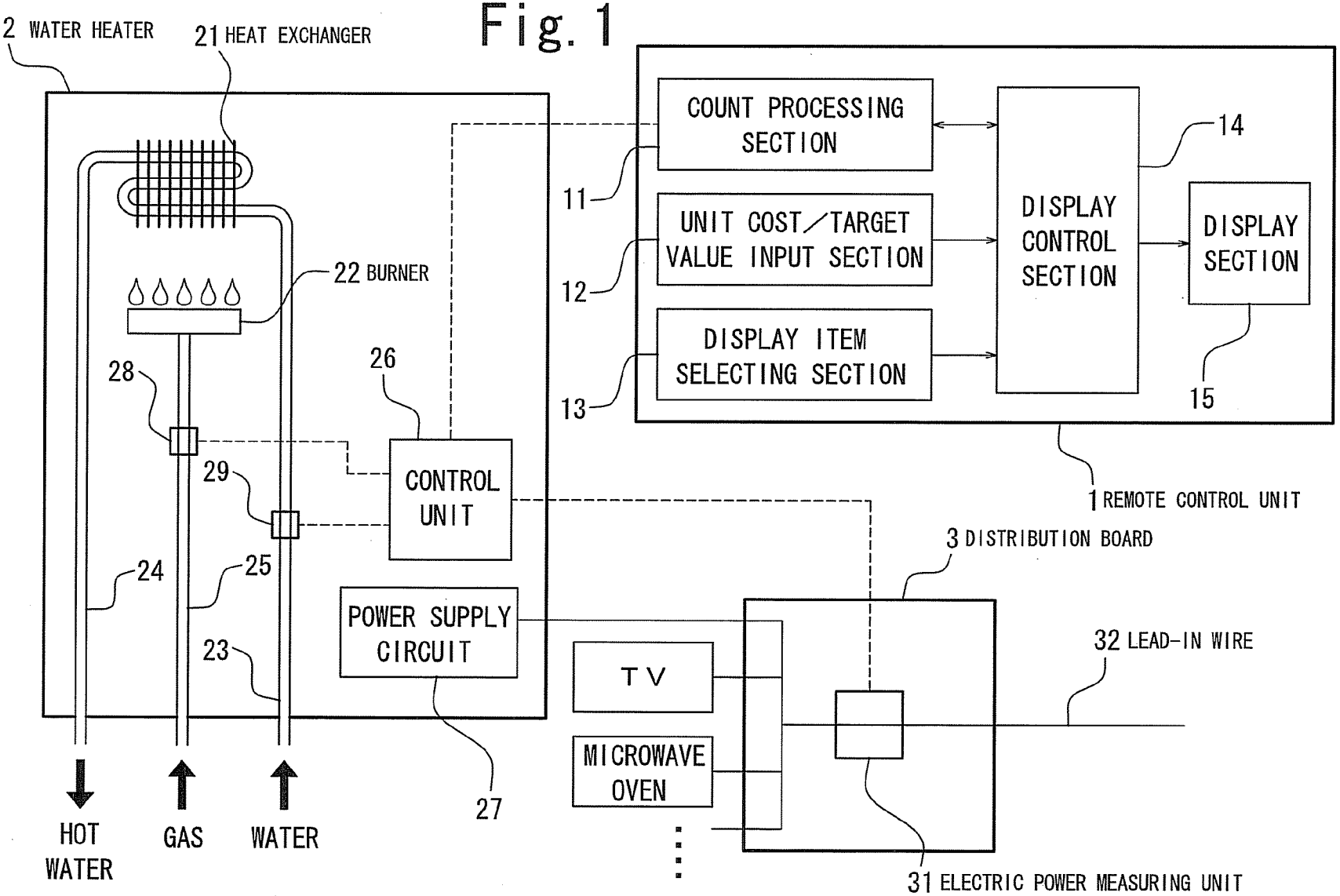
FIG. 1 is a block diagram showing an outline configuration of an energy usage display unit (applied to a remote control unit of a water heater) according to a first embodiment.

As shown in FIG. 1, the water heater 2 includes a heat exchanger 21, a burner 22 for heating the heat exchanger 21, a water supply pipe 23 and a hot water outlet pipe 24 connected to the heat exchanger 21 through pipes, a gas supply pipe 25 through which fuel gas is supplied to the burner 22, a control unit 26 for controlling operation of the water heater 2, and a power supply circuit 27. The remote control unit 1 is communication connected to the control unit 26.

The gas supply pipe 25 is provided with a gas amount measuring device 28 for continuously measuring a gas amount used in the water heater 2. A signal indicative of a measurement value of the gas amount measured by the gas amount measuring device 28 is sent to the remote control unit 1 through the control unit 26. The water supply pipe 23 is provided with a water amount measuring device 29 for continuously measuring a water amount used in the water heater 2. A signal indicative of a measurement value of the water amount measured by the water amount measuring device 29 is sent to the remote control unit 1 through the control unit 26. A device or the like which generates a pulse signal whenever a measured amount reaches a predetermined value can be used as the gas amount measuring device 28 and the water amount measuring device 29. The water amount measuring device 29 can measure the water amount even when an operation switch of the remote control unit 1 is OFF and the burner 22 does not burn.

Concerning electric power, a distribution board 3 of the housing where the water heater 2 is set is provided with an electric power measuring unit 31 for continuously measuring electricity usage of the housing. A signal indicative of a measurement value of the electricity usage measured by the electric power measuring unit 31 is sent to the remote control unit 1 through the control unit 26. In the distribution board 3, a lead-in wire 32 which is pulled in from an electric power transmission line (not shown) is branched into electric outlets. The electric power measuring unit 31 is connected to the lead-in wire 32 and measures the electricity usage used in the housing. The power supply circuit 27 of the water heater 2 is also connected to the electric outlet which is branched off from the lead-in wire 32.

As a configuration for providing an energy usage display unit of the present invention, the remote control unit 1 includes a count processing section 11, a unit cost/target value input section 12, a display item selecting section 13, a display control section 14 and a display section 15. As the display section 15, it is possible to use various display units such as a liquid crystal display unit, an LED display unit, a dot matrix display unit and the like.

Figure 2:
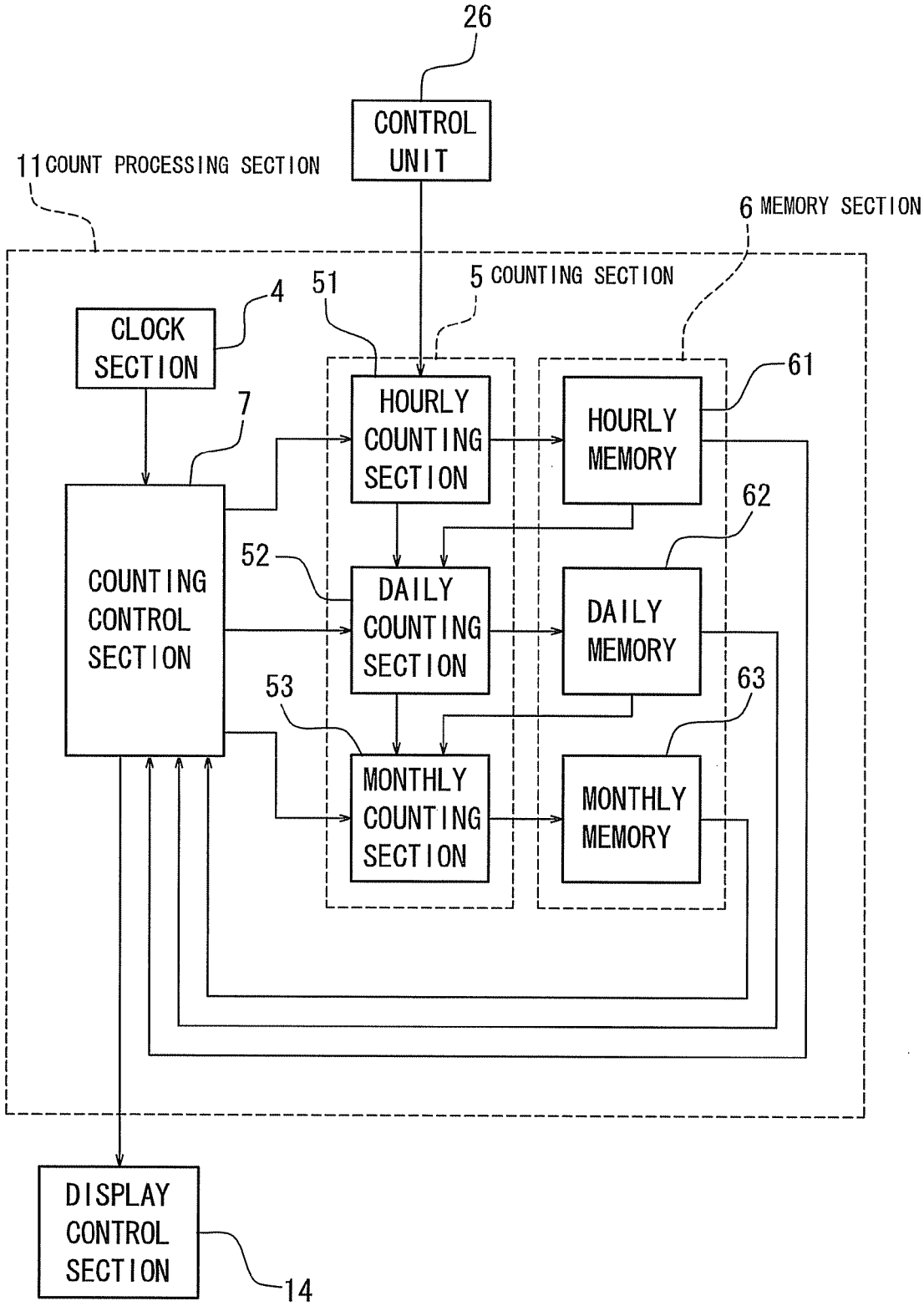
FIG. 2 is a block diagram showing a configuration of a count processing section in the energy usage display unit according to the first embodiment.

The count processing section 11 calculates and stores various usages of gas, water service and electricity from various measurement value signals sent from the control unit 26 of the water heater 2. As shown in FIG. 2, the count processing section 11 includes a clock section 4, a counting section 5, a memory section 6 and a counting control section 7. The counting section 5 includes an hourly counting section 51, a daily counting section 52 and a monthly counting section 53. The memory section 6 includes an hourly memory 61, a daily memory 62 and a monthly memory 63.

The clock section 4 includes a clock function for counting time such as hours and minutes, and a calendar function for counting dates such as years, months and days. The clock section 4 supplies the clock data to the counting control section 7. Date and time in the clock section 4 can manually be set by a time setting section (not shown).

The hourly counting section 51 adds up and counts usage based on a signal sent from the water heater 2. The counting control section 7 refers to the clock data sent from the clock section 4, and writes, in the hourly memory 61, a count value of usage in the hourly counting section 51 counts from previous 0 minute count 0 minute at 0 minute every hour as one hour usage. That is, in the hourly counting section 51, usage of one hour from 20:00 to 21:00 is defined as usage at 20 o'clock (at 8 PM) when the clock section 4 counts 21:00 (=20:60).

The hourly memory 61 stores usage (gas, water or electricity) for one hour counted by the hourly counting section 51 retroactive to past by last 48 hours with one hour unit in correspondence at that time zone (for example, "20 o'clock"). That is, at 0 minute every hour, usage of the oldest one hour before 48 hours stored in the hourly memory 61 is rewritten in the latest one hour usage data, and the latest 48 hours usage data is always left in the hourly memory 61.

The daily counting section 52 calculates usage from 0 o'clock to 24 o'clock to count usage for one day. The daily counting section 52 adds a count value of usage of one hour from 23:00 to 24:00 calculated by the hourly counting section 51 to a stored value of usage of latest 23 hours in the hourly memory 61 at 0 o'clock everyday. The counting control section 7 refers to the clock data from the clock section 4, at 0 o'clock everyday, writes in the daily memory 62, a count value of usage in the daily counting section 52 as one day count value (gas, water or electricity) of yesterday. That is, in the daily counting section 52, at 0 o'clock every day, usage of one hour from 23:00 to 24:00 of yesterday counted by the hourly counting section 51 is added to usage from 0:00 to 23:00 of yesterday stored in the hourly memory 61, thereby counting one day usage of yesterday. At 0 o'clock every day, the daily counting section 52 may count stored values of usage of last 24 hours in the hourly memory 61, i.e., usage from 0:00 to 24:00 of yesterday, as one day usage of yesterday.

The daily memory 62 stores usage (gas, water and electricity) of one day counted by the daily counting section 52 retroactive to past by 31 days with one day unit in association with date of the usage. That is, in the daily memory 62, the oldest one day usage data before 31 days stored in the daily memory 62 is rewritten in the latest one day usage data at 0 o'clock, and the latest 31 days usage data is always left in the daily memory 62.

The monthly counting section 53 calculates usage from the first day to the last day of the month, to count usage for one month. The monthly counting section 53 counts stored values of usage from the first day to the last day of the last month to be stored in the daily memory 62 at 0 o'clock of the first day of the month. The counting control section 7 refers to the clock data from the clock section 4, writes the same in the monthly memory 63, a count value of the monthly counting section 53 as one month count value (gas, water and electricity) of last one month. That is, in the monthly counting section 53, when the clock section 4 counts 0 o'clock of December 1, usage from November 1 to 30 is read from the daily memory 62 and calculates the same as November usage.

The monthly memory 63 stores usage (gas, water and electricity) of one month counted by the monthly counting section 53 in association with year and month retroactive to past by last 13 months with one month unit. That is, at 0 o'clock of the first day of the month, usage data of the oldest one month before 13 months stored in the monthly memory 63 is rewritten in the usage data of the latest one month, and the latest 13 months usage data is always left in the monthly memory 63.

Figure 3:
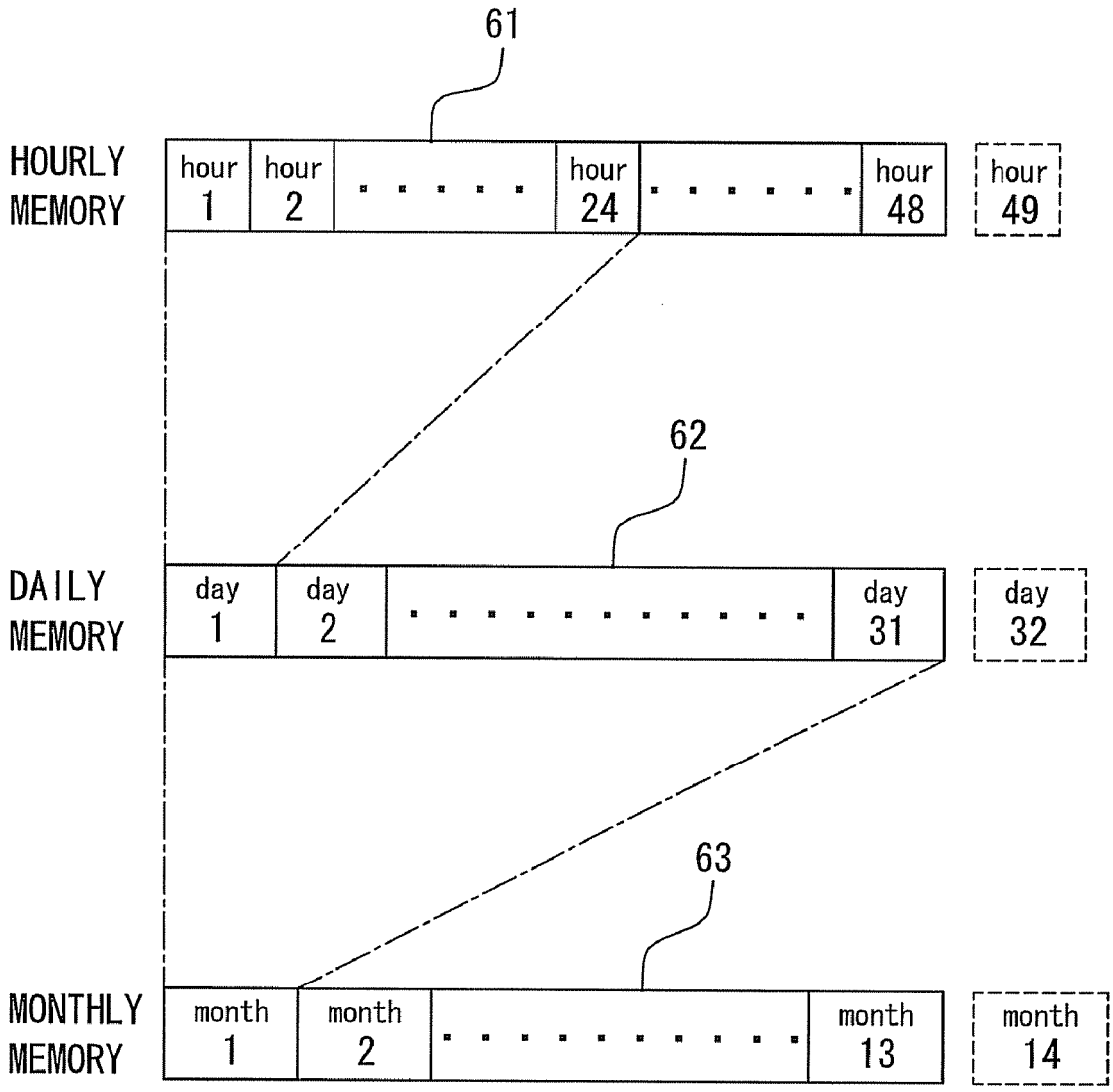
FIG. 3 is a schematic diagram showing a correlation between an hourly memory, a daily memory and a monthly memory according to the first embodiment.

FIG. 3 schematically shows a relationship between the hourly memory 61, the daily memory 62 and the monthly memory 63. As show in FIG. 3, usage of the latest 24 hours in the hourly memory 61 corresponds to usage of one day of the daily memory 62, and the latest 31 days, 30 days, 28 days or 29 days of the daily memory 62 corresponds to one month usage of the monthly memory 63.

The counting section 5 does not calculate usage in the preset count period but adds up actual usage at 0 minute every hour. Therefore, even if time of the clock section 4 is changed, a count value of usage data which was added before the time is changed is not reset. Thus, the actual usage can be added up at 0 minute even after the time of the clock section 4 is changed, and the past actual usage can be displayed for comparison without any problem.

Thus, even if time unit to be displayed is changed to greater period unit, the current usage and past usage in a comparison period can be displayed on the display section 15 with period unit after the change utilizing a count value of the counting section 5 and a stored value of the memory section 6.

Figure 6:
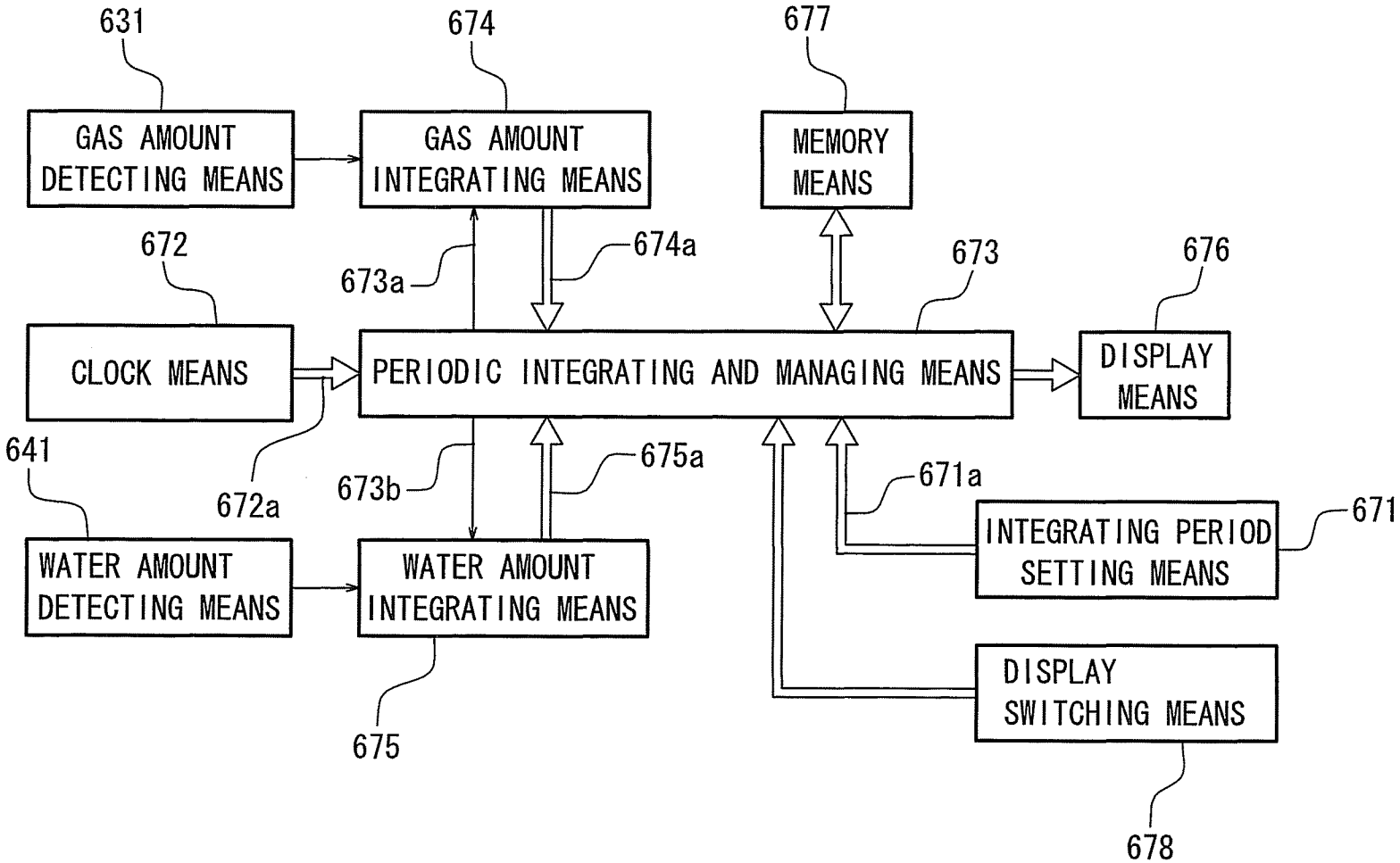
Fig. 6 PRIOR ART
FIG. 6 is a block diagram showing a configuration of an essential portion for displaying usage of gas and water in a conventional water heater.

On the other hand, the memory means 677 of the conventional water heater (Japanese Patent No. 3061215) shown in FIG. 6 merely stores the integration data and thus, available capacity will soon be filled as time is elapsed, new integration value can not be stored and the latest past usage can not be displayed. Compared with this configuration, the memory section 6 having the above-described configuration stores usage of the latest given period only. Therefore, available capacity will not soon be filled and the latest usage can be stored, and a large-capacity memory is not required. With this configuration, even if long time is elapsed, usage utilizing the latest past usage data can be displayed.

In FIG. 1, the unit cost/target value input section 12 sets target values (target value setting means) of gas, water and electricity, and sets (unit cost setting means) of unit costs, and has item keys and numeric value inputting keys (not shown) and the like for setting the various values.

The display item selecting section 13 includes various selection keys (not shown) for selecting displayed items on the display section 15. Examples of the selection keys are a screen selection key, a unit selection key, an energy selection key and a period selection key or the like.

In this case, the screen selection key is used for selecting whether usage should be displayed in the form of a list (list display selecting section), whether the current usage and a target value should be displayed for comparison (target value comparison display selecting section), and whether the current usage and past usage should be displayed for comparison (past comparison display selecting section) by operating the screen selection key.

The unit selection key is used for selecting a unit of usage to be displayed(for example, whether unit of gas and water should be "volume", unit of electricity should be "watt"), or unit of money should be selected (whether unit is "Yen") by operating the unit selection key.

The energy selection key is used for selecting which one of gas, water and electricity should be displayed, and whether the costs of gas, water and electricity should be totalized and displayed as utilities for heat and electricity by operating the energy selection key.

The period selection key is used for selecting a period unit for displaying day, week, month and the like.

The display control section 14 reads various stored values in the memory section 6 and count values in the hourly counting section 51 in the count processing section 11 in accordance with request from the display item selecting section 13, prepares display data to be displayed on the display section 15, and outputs the same to the display section 15.

For example, a count value of usage until the current time of today is a total of all of usage after 0 o'clock of today stored in the hourly memory 61 and usage of the current time zone which is added up by the hourly counting section 51. Therefore, in a case where usage of today is to be displayed, a stored value in the hourly memory 61 and a count value in the hourly counting section 51 are read, these values are edited in chronological order by each hour or are totalized, and output to the display section 15.

Further, a count value of usage until the current time of this month is a total of the entire usage after the first day of this month stored in the daily memory 62 and usage from 0 o'clock to the current time of today as described above. Therefore, in a case where usage of this month is to be displayed, a stored value in the daily memory 62, a stored value in the hourly memory 61 and a count value in the hourly counting section 51 are read, these values are edited in chronological order by each day or are totalized, and output to the display section 15.

Further, a count value of usage until to the current time of this year is a total of entire usage after January of this year stored in the monthly memory 63 and usage from the first day of this month to the current time of today as described above. Therefore, when usage of this year is to be displayed, a stored value in the monthly memory 63, a stored value in the daily memory 62, a stored value in the hourly memory 61 and a count value in the hourly counting section 51 are read, these values are edited in chronological order by each month or are totalized, and output to the display section 15.

When past usage is to be displayed, necessary usage is read from the hourly memory 61, the daily memory 62 and the monthly memory 63 in accordance with that period unit (hour, day, week, month and the like), and the same is output to the display section 15.

Next, a concrete example of display will be explained.

(Display of List)

Figure 4A:
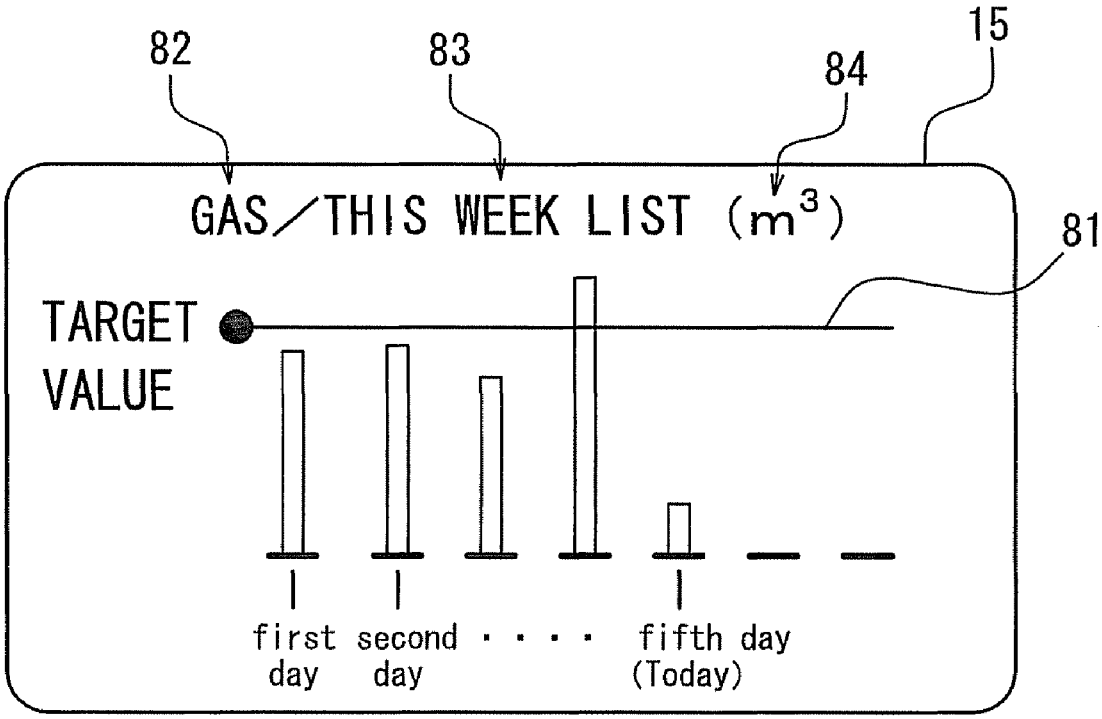

In a case where a list display of usage in a comparison period is selected by the screen selection key as list display selecting section of the display item selecting section 13, a period unit such as "today", "yesterday", "this week", "this month", "this year" and the like can be selected by the period selection key of the display item selecting section 13. In this case, the display control section 14 reads necessary data from the count processing section 11 in accordance with a period unit required by a user selected by the period selection key, and display data is calculated and prepared. As shown in FIG. 4A for example, usage is displayed on the display section 15 by means of a bar chart in chronological order by with a fixed time unit. In the list display screen shown in FIG. 4A, a line 81 showing a target value which is set by the unit cost/target value input section 12, indication 82 of energy kind such as gas, water and electricity, indication 83 of selected period unit, and unit 84 of volume, watt and cost are shown. FIG. 4A shows an example of the list display of usage of "this week" as the period unit of the fixed unit, and seven bars (seven days) can be shown, but the number of bars is changed in accordance with the period unit.

By showing usage in the form of a list in this manner, transition of usage of the current time in the comparison period can be seen at a glance and thus, this information can be used for saving energy in the future.

(Comparison Display Between Current Usage and Target Value)

Figure 4B:
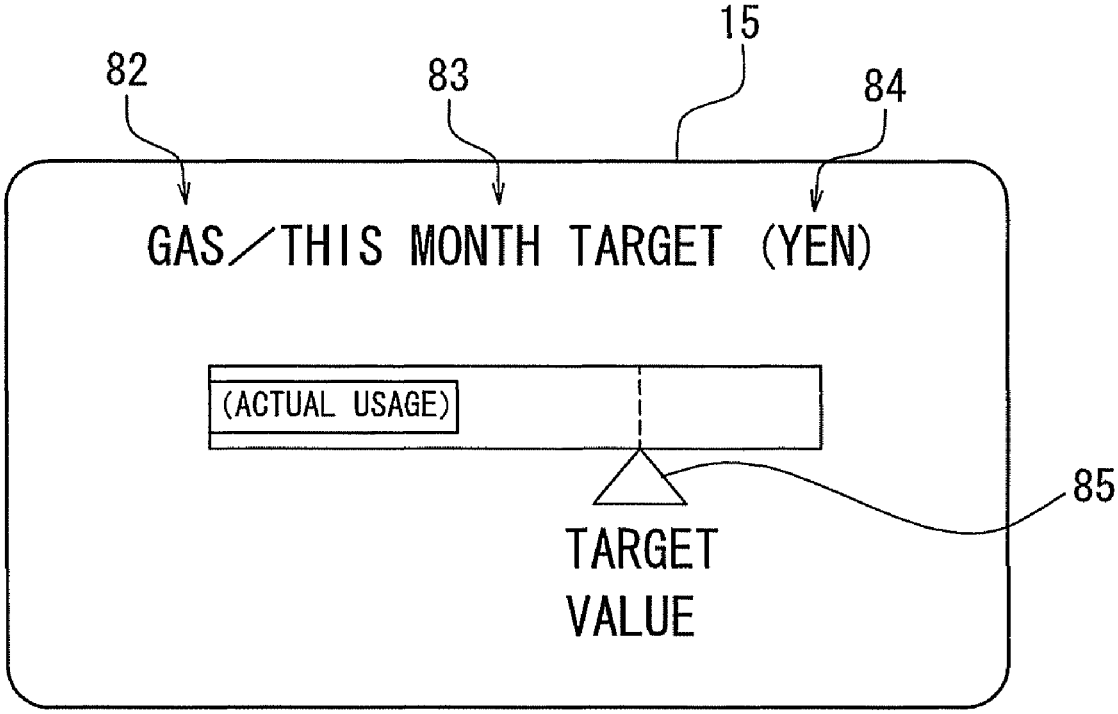

In a case where a comparison display for comparing the current usage with the target value is selected by the screen selection key as the target value comparison display selecting section of the display item selecting section 13, a period unit such as "today", "this week", "this month" or the like can be selected by the period selection key of the display item selecting section 13. In this case, the display control section 14 reads necessary data from the count processing section 11 in accordance with a period unit required by a user selected by the period selection key, and display data is calculated and prepared. As shown in FIG. 4B for example, a ratio of usage of this month, this week or today with respect to a target value which is set by the unit cost/target value input section 12 as the target value setting means is indicated on the display section 15 by means of a band chart. A mark 85 indicative of a target value which is set by the unit cost/target value input section 12, indication 82 of energy kind of gas, water and electricity, indication 83 of selected period unit, and unit 84 of volume, watt and cost are shown on the target value comparison display screen shown in FIG. 4B.

By showing the current usage in comparison with a target value in the comparison period in this manner, a ratio of the current usage to the target value can be seen at a glance and thus, this information can be used for saving energy in the future.

(Comparison Display Between Current Usage and Past Usage)

Figure 4C:
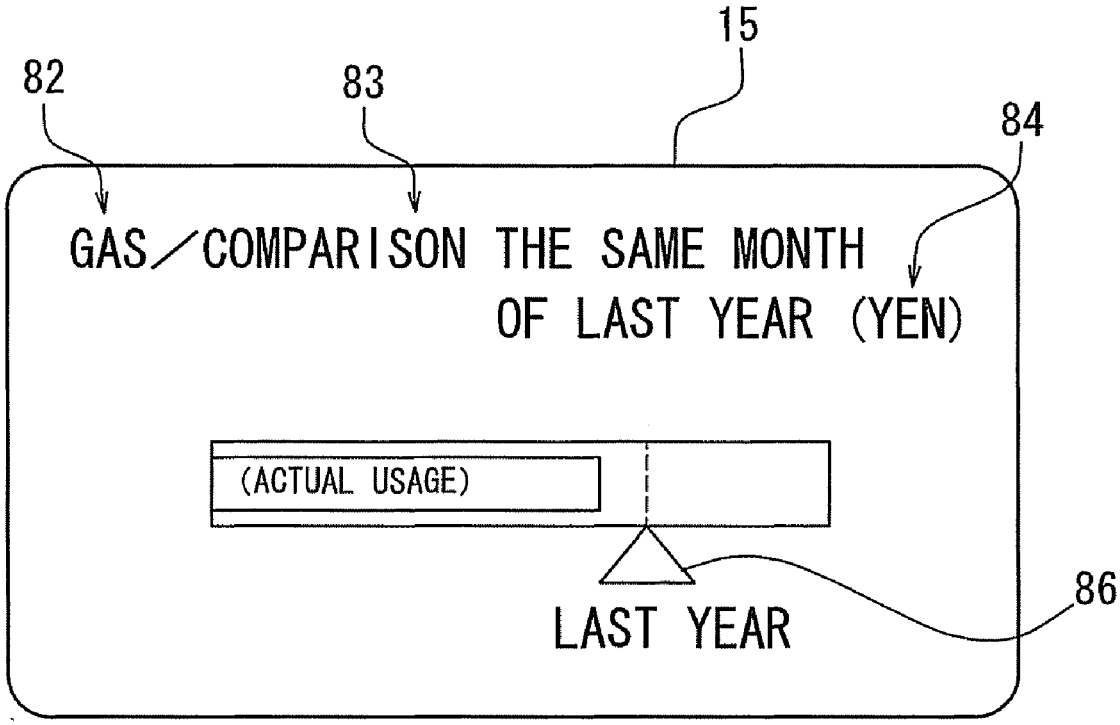

In a case where the comparison display in which the current usage is compared with the past usage is selected by the screen selection key as the past comparison display selecting section of the display item selecting section 13, a period unit such as "the same month of last year", "last month", "last week", "yesterday" or the like can be selected by the period selection key of the display item selecting section 13. In this case, the display control section 14 reads necessary data from the count processing section 11, and display data is calculated and prepared. As shown in FIG. 4C for example, a ratio of usage of this month, this week or today with respect to the past usage of a period to be compared is indicated on the display section 15 by means of a band chart. A mark 86 indicative of the past usage of the comparison period, indication 82 of energy kind of gas, water and electricity, indication 83 of selected period unit, and unit 84 of volume, watt and cost are shown on the past comparison display screen shown in FIG. 4C. FIG. 4C shows "the same month of last year" as the comparison period. In this case, a count value is displayed in the form of monthly display corresponding to the period unit of the comparison period, and, usage of "this month" is shown. That is, a period unit of the count value of the current usage is displayed in correspondence with a period unit of the comparison period.

By showing the count usage in comparison with the past usage in the comparison period in this manner, a ratio of the current usage to the past usage can be seen at a glance and thus, this information can be used for saving energy in the future.

In any of the above display screens, usage and estimate cost can be switched and displayed by the unit selection key, and the gas, water, electricity, or the total utilities for heat and electricity can be switched and displayed by the energy selection key.

According to the first embodiment, a count value of usage is overwritten in the memory section 6 from the counting section 5 at the predetermined time. Therefore, even if the period unit of usage to be displayed is changed, usage data added up by the counting section 5 is not reset and the count value of the usage is recorded in the memory section 6 at the predetermined time. The count value of usage of gas or the like used in the water heater 2 is recorded in the memory section 6 at the predetermined time unit, but when this is displayed, display data of usage is prepared in accordance with a period unit required by a user with the display control section 14. Thus, it is possible to display, on the display section 15, usage such as gas usage used in the water heater 2 in accordance with a period unit required by a user irrespective of the period unit to be recorded in the memory section 6.

When energy usage such as gas and water used in the water heater 2 is displayed, even if the period unit of usage to be displayed is changed, usage data which is added up by the counting section 5 is not reset and usage data is recorded in the memory section 6 at predetermined time. Thus, current and past usage can be displayed with the period unit after change by utilizing a count value of the counting section 5 and a stored value of the memory section 6. With this configuration, it is possible to reliably display transition of energy usage in accordance with not only a single period unit but also period unit required by a user such as a day unit or a month unit. Therefore, this information can be used for saving energy such as usage of gas and water for the water heater 2 and usage of electricity at housing.

Second Embodiment

Figure 5:
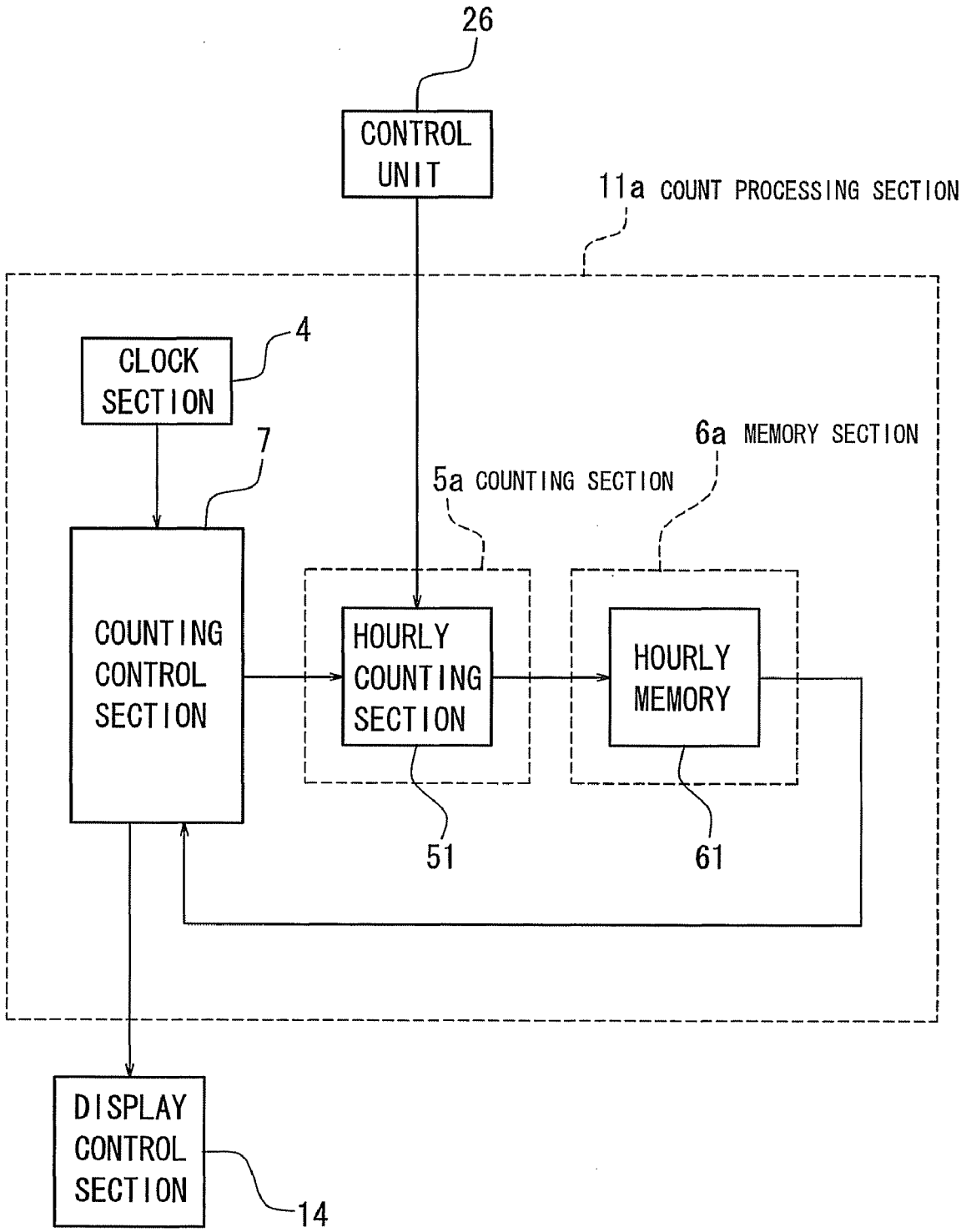
FIG. 5 is a block diagram showing a configuration of a count processing section in an energy usage display unit according to a second embodiment.

In the second embodiment, as shown in FIG. 5, a count processing section 11*a* does not include the daily memory 62, the monthly memory 63, the daily counting section 52 and the monthly counting section 53 of the first embodiment, while the counting section 5*a* is configured in a hourly counting section 51, and a memory section 6*a* is configured in a hourly memory 61. In this case, like FIG. 1, the display control section 14 reads usage data in the hourly memory 61 and the hourly counting section 51 in accordance with a period unit required by a user with the display item selecting section 13, calculates and prepares display data for displaying the usage data on the display section 15, and outputs the same on the display section 15. Therefore, in order to compare a current usage with a past usage in a comparison period usage data of past in the comparison period is stored in the hourly memory 61. With this configuration, similar to the first embodiment, it is possible to display comparison the current usage with past usage such as "yesterday", "last week", "last month", "the same month of last year" and the like. Other configuration of the energy usage display unit of the second embodiment is similar to that of the first embodiment.

Other Embodiment

The present invention is not limited to the embodiments, and the following modifications (1) to (3) can be made.

(1) The data recording periods of the hourly memory 61, the daily memory 62 and the monthly memory 63 can freely be set in accordance with past period for displaying compare for past data or displaying past usage.

(2) When monthly usage in the monthly memory 63, the monthly counting section 53 and the counting control section 7 is counted, the first day of a month, may be next day of a predetermined cut off day.

(3) A gas amount used in the water heater 2 is obtained by directly measuring an amount of gas supplied to the gas supply pipe 25 by the gas amount measuring device 28, but alternatively, a temperature difference between a set temperature at the remote control unit 1 and water temperature at the water supply pipe 23 is multiplied by a water amount at the water supply pipe 23 to obtain a required amount of heat, and a gas supply amount which is calculated based on this required amount of heat and an amount of heat per unit amount of gas kind may be used as the gas amount.

As described in detail above, according to a first aspect of the invention, there is provided an energy usage display unit for displaying energy usage of gas used for a water heater, water used for the water heater or electricity used in a housing where the water heater is set, comprising:

a clock section for having a clock and calendar function;

a counting section for counting usage of gas, water or electricity;

a memory section for storing a count value of usage counted by the counting section retroactive to past by a predetermined number with a predetermined time unit;

a counting control section for writing the count value of usage from the counting section to the memory section at predetermined time;

a display control section for reading one or both of the count value of the counting section and a stored value in the memory section to prepare display data of usage, in accordance with a period unit required by a user; and a display section for displaying usage based on the display data prepared by the display control section.

According to the above configuration, a count value of usage is overwritten in the memory section from the counting section at the predetermined time. Therefore, even if the period unit of usage to be displayed is changed, usage data added up by the counting section is not reset and the count value of the usage is recorded in the memory section at the predetermined time. The count value of usage of gas or the like used in the water heater is recorded in the memory section at the predetermined time unit, but when this is displayed, display data of usage is prepared in accordance with period unit required by a user by the display control section. Thus, it is possible to display, on the display section, usage such as gas usage used in the water heater in accordance with a period unit required by a user irrespective of period unit to be recorded in the memory section.

When energy usage such as gas and water used in the water heater is displayed, even if the period unit of usage to be displayed is changed, usage data which is added up by the counting section is not reset and usage data is recorded in the memory section at predetermined time. Thus, current and past usage can be displayed with period unit after change by utilizing a count value of the counting section and a stored value of the memory section. With this configuration, it is possible to reliably display transition of energy usage in accordance with not only a single period unit but also period unit required by a user daily, monthly or the like. Therefore, this information can be used for saving energy such as usage of gas and water for in the water heater and usage of electricity at housing.

According to a second aspect of the invention, in the energy usage display unit above, the counting section includes an hourly counting section for adding up usage of gas, water or electricity sent through the water heater, the memory section includes an hourly memory for storing the count value of usage retroactive to past by a predetermined now number with an hour unit, and the counting control section controls such that at 0 minute every hour, the count value of at the hourly counting section added up usage from previous 0 minute to current 0 minute is written in the hourly memory as usage for one hour at that time.

According to the above configuration, even if time unit is changed to greater period unit, the current usage and past usage can be displayed on the display section with period unit after the change utilizing a count value of the counting section and a stored value of the memory section.

Therefore, in a case where usage to the current time of today is to be displayed, a stored value in the hourly memory and a count value in the hourly counting section are read, these values are edited in time sequence based on time or are totalized, and display on the display section.

According to a third aspect of the invention, in the energy usage display unit above, the counting section includes a daily counting section for counting usage from 0 o'clock to 24 o'clock as usage for one day, the memory section includes a daily memory for storing one day count value of usage retroactive to past by a predetermined day number with a day unit, the daily counting section counts, as one day usage of yesterday, the one day count value obtain by adding usage of one hour from 23:00 to 24:00 of yesterday counted by the hourly counting section to usage from 0:00 to 23:00 of yesterday stored in the hourly memory at 0 o'clock, and the counting control section controls such that the one day count value counted by the daily counting section is written in the daily memory as the one day usage of yesterday at 0 o'clock.

According to the above configuration, even if time unit is changed to greater period unit, the current usage and past usage can be displayed on the display section with period unit after the change utilizing a count value of the counting section and a stored value of the memory section.

Therefore, in a case where usage to the current time of this month is to be displayed, a stored value in the daily memory, a stored value in the hourly memory and a count value in the hourly counting section are read, these values are edited in time sequence based on day or are counted, and display on the display section.

According to a fourth aspect of the invention, in the energy usage display unit above, the counting section includes an daily counting section for counting usage from 0 o'clock to 24 o'clock as usage for one day, the memory section includes a daily memory for storing one day count value of usage retroactive to past by a predetermined day number with a day unit, the daily counting section counts, as one day usage of yesterday, stored values of usage of last 24 hours in the hourly memory at o'clock, and the control section controls such that at the one day count value counted by the daily counting section is written in the daily memory as the one day usage of yesterday at 0 o'clock.

According to the above configuration, even if time unit is changed to greater period unit, the current usage and past usage can be displayed on the display section with period unit after the change utilizing a count value of the counting section and a stored value of the memory section.

Therefore, in a case where usage to the current time of this month is to be displayed, a stored value in the daily memory, a stored value in the hourly memory and a count value in the hourly counting section are read, these values are edited in time sequence based on day or are counted, and display on the display section.

According to a fifth aspect of the invention, in the energy usage display unit above, the counting section includes a monthly counting section for counting usage from the first day to the last day of the month as usage of that one month, the memory section includes a monthly memory for storing one month count value of usage retroactive to past by a predetermined month number with a month unit, the monthly counting section counts, as one month usage of last one month, stored values from the first day to the last day of the last month in the daily memory at 0 o'clock of the first day of the month, and the counting control section controls such that the one month count value counted by the monthly counting section is written in the monthly memory as the one month usage of last one month at 0 o'clock of the first day of the month.

According to the above configuration, even if time unit is changed to greater period unit, the current usage and past usage can be displayed on the display section with period unit after the change utilizing a count value of the counting section and a stored value of the memory section.

Therefore, when usage to the current time of this year is to be displayed, a stored value in the monthly memory, a stored value in the daily memory, a stored value in the hourly memory and a count value in the hourly counting section are read, these values are edited in time sequence based on month or are counted, and display on the display section.

According to a sixth aspect of the invention, in the energy usage display unit above, further comprising a past comparison display selecting section for selecting a comparison display between a current usage and a past usage in a comparison period, wherein the display control section controls such that the count value of the counting section and the stored value of the memory section are read out and added to prepare the display data for displaying comparison the current usage with the past usage in the comparison period.

According to the above configuration, by showing the count usage in comparison with the past usage in the comparison period in this manner, a ratio of the current usage to the past usage can be seen at a glance and thus, this information can be used for saving energy in the future.

According to a seventh aspect of the invention, in the energy usage display unit above, further comprising target value setting means for setting a target value, and a target value comparison display selecting section for selecting a comparison display between a current usage and the target value in a comparison period, wherein the display control section controls such that the count value of the counting section, or the count value of the counting section and the stored value of the memory section are read out and added to prepare the display data for displaying comparison the current usage with the target value in the comparison period.

According to the above configuration, by showing the current usage in comparison with a target value in the comparison period in this manner, a ratio of the current usage to usage of the target value can be seen at a glance and thus, this information can be used for saving energy in the future.

According to a eighth aspect of the invention, in the energy usage display unit above, further comprising a list display selecting section for selecting a list display of usage, wherein the display control section controls such that the count value of the counting section and the stored value of the memory section are read and added to prepare the display data for displaying a current usage with a fixed time unit in chronological order.

According to the above configuration, by showing usage in the form of a list in this manner, transition of usage of the current time in the comparison period can be seen at a glance and thus, this information can be used for saving energy in the future.

Therefore, according to the invention, when energy usage such as gas and water used in the water heater is displayed, even if the period unit of usage to be displayed is changed, usage data which is added up by the counting section is not reset and usage data is recorded in the memory section at predetermined time. Thus, current and past usage can be displayed with period unit after change by utilizing account value of the counting section and a stored value of the memory section. With this configuration, it is possible to reliably display transition of energy usage in accordance with not only a single period unit but also period unit required by a user daily, monthly or the like. Therefore, this information can be used for saving energy such as usage of gas and water for in the water heater and usage of electricity at housing.

The present application claims priority based on a Japanese Patent Application No. 2006-344751 filed on Dec. 21, 2006, the content of which is hereby incorporated by reference in its entirely.

Although the present invention has been described in detail, the foregoing descriptions are merely exemplary at all aspects, and do not limit the present invention thereto. It should be understood that an enormous number of un-illustrated modifications may be assumed without departing from the scope of the present invention.

The invention claimed is:

1. An energy usage display unit for displaying energy usage of gas used for a water heater, water used for the water heater or electricity used in a housing where the water heater is set, comprising:

a clock section for having a clock and calendar function;

a counting section for counting usage of gas, water or electricity, the counting section having an hourly counting section, a daily counting section, and a monthly counting section;

a memory section for storing a count value of usage counted by the counting section retroactive to past by a predetermined number with a predetermined time unit and rewriting the count value of the oldest usage with the predetermined time unit to the count value of the latest usage with the predetermined time unit, the memory section having an hourly memory, a daily memory, and a monthly memory;

a counting control section for writing the count value of usage from the counting section to the memory section;

a display control section for reading either or both of the count value of the counting section and a stored value in the memory section to prepare display data of usage, in accordance with a period unit required by a user; and a display section for displaying usage based on the display data prepared by the display control section, wherein the hourly counting section for adding up usage of gas, water or electricity sent through the water heater from previous 0 minute to current 0 minute at time 0 minute, the daily counting section counts, as one day usage of yesterday from 0:00 to 24:00, the one day count value obtained by adding a count value of one hour usage of one hour from 23:00 to 24:00 of yesterday counted by the hourly counting section to stored values of usage with an hour unit from 0:00 to 23:00 of yesterday stored in the hourly memory at 0 o'clock 0 minute, the monthly counting section counts, as one month usage of last one month from the first day to the last day, stored values of usage with a day unit from the first day to the last day of the last month in the daily memory at 0 o'clock 0 minute of the first day of the month, the hourly memory for storing the count value of usage counted by the hourly counting section retroactive to past by a predetermined hour number with the hour unit at time 0 minute and rewriting the count value of the oldest one hour usage with the hour unit to the count value of the latest one hour usage with the hour unit at time 0 minute, the daily memory for storing one day count value of usage counted by the daily counting section retroactive to past by a predetermined day number with the day unit at 0 o'clock 0 minute and rewriting the count value of the oldest one day usage with the day unit to the count value of the latest one day usage with the day unit at 0 o'clock 0 minute, the monthly memory for storing one month count value of usage counted by the monthly counting section retroactive to past by a predetermined month number with a month unit and rewriting the count value of the oldest one month usage with the month day unit to the count value of the latest one month usage with the month unit at 0 o'clock 0 minute of the first day of the month, the counting control section controls such that at 0 minute every hour, the count value added up usage from previous 0 minute to current 0 minute at the hourly count section is written in the hourly memory as the latest one hour usage with the hour unit and the count value of the oldest one hour usage with the hour unit stored in the hourly memory is rewritten to the count value of the latest one hour usage with the hour unit, the counting control section controls such that the one day count value of usage counted by the daily counting section is written in the daily memory as the one day usage of yesterday with the day unit at 0 o'clock 0 minute and the count value of the oldest one day usage with the day unit stored in daily memory is rewritten to the count value of the one day usage of yesterday with the day unit at 0 o'clock 0 minute, and the counting control section controls such that the one month count value of last one month usage counted by the monthly counting section is written in the monthly memory as the one month usage of last one month with the month unit at 0 o'clock 0 minute of the first day of the month and the count value of the oldest one month usage with the month unit stored in the monthly memory is rewritten to the count value of the latest one month usage with the month unit at 0 o'clock 0 minute of the first day of the month.

2. An energy usage display unit for displaying energy usage of gas used for a water heater, water used for the water heater or electricity used in a housing where the water heater is set, comprising:

a clock section for having a clock and calendar function;

a counting section for counting usage of gas, water or electricity, the counting section having an hourly counting section, a daily counting section, and a monthly counting section;

a memory section for storing a count value of usage counted by the counting section retroactive to past by a predetermined number with a predetermined time unit and rewriting the count value of the oldest usage with the predetermined time unit to the count value of the latest usage with the predetermined time unit, the memory section having an hourly memory, a daily memory, and a monthly memory;

a counting control section for writing the count value of usage from the counting section to the memory section;

a display control section for reading either or both of the count value of the counting section and a stored value in the memory section to prepare display data of usage, in accordance with a period unit required by a user; and a display section for displaying usage based on the display data prepared by the display control section, wherein the hourly counting section for adding up usage of gas, water or electricity sent through the water heater from previous 0 minute to current 0 minute at time 0 minute, the daily counting section counts, as one day usage of yesterday, stored values of usage with an hour unit from 0:00 to 24:00 of yesterday stored in the hourly memory at 0 o'clock 0 minute, the monthly counting section counts, as one month usage of last one month from the first day to the last day, stored values of usage with a day unit from the first day to the last day of the last month in the daily memory at 0 o'clock 0 minute of the first day of the month, the hourly memory for storing the count value of usage counted by the hourly counting section retroactive to past by a predetermined hour number with the hour unit at time 0 minute and rewriting the count value of the oldest one hour usage with the hour unit to the count value of the latest one hour usage with the hour unit at time 0 minute, the daily memory for storing one day count value of usage counted by the daily counting section retroactive to past by a predetermined day number with the day unit at 0 o'clock 0 minute and rewriting the count value of the oldest one day usage with the day unit to the count value of the latest one day usage with the day unit at 0 o'clock 0 minute, the monthly memory for storing one month count value of usage counted by the monthly counting section retroactive to past by a predetermined month number with a month unit and rewriting the count value of the oldest one month usage with the month unit to the count value of the latest one month usage with the month unit at 0 o'clock 0 minute of the first day of the month, the counting control section controls such that at 0 minute every hour, the count value added up usage from previous 0 minute to current 0 minute at the hourly count section is written in the hourly memory as the latest one hour usage with the hour unit and the count value of the oldest one hour usage with the hour unit stored in the hourly memory is rewritten to the count value of the latest one hour usage with the hour unit, the counting control section controls such that the one day count value of usage counted by the daily counting section is written in the daily memory as the one day usage of yesterday with the day unit at 0 o'clock 0 minute and the count value of the oldest one day usage with the day unit stored in the daily memory is rewritten to the count value of the one day usage of yesterday with the day unit at 0 o'clock 0 minute, and the counting control section controls such that the one month count value of last one month usage counted by the monthly counting section is written in the monthly memory as the one month usage of last one month with the month unit at 0 o'clock 0 minute of the first day of the month and the count value of the oldest one month usage with the month unit stored in the monthly memory is rewritten to the count value of the latest one month usage with the month unit at 0 o'clock 0 minute of the first day of the month.

3. The energy usage display unit according to claim 1, further comprising a list display selecting section for selecting a list display of usage, wherein the display control section controls such that the count value of the counting section and the stored value of the memory section are read and added to prepare the display data for displaying a current usage with a fixed time unit in chronological order.

4. The energy usage display unit according to claim 1, further comprising a past comparison display selecting section for selecting a comparison display between a current usage and a past usage in a comparison period, wherein the display control section controls such that the count value of the counting section and the stored value of the memory section are read out and added to prepare the display data for displaying comparison the current usage with the past usage in the comparison period.

5. The energy usage display unit according to claim 1, further comprising target value setting means for setting a target value, and a target value comparison display selecting section for selecting a comparison display between a current usage and the target value in a comparison period, wherein the display control section controls such that the count value of the counting section, or the count value of the counting section and the stored value of the memory section are read out and added to prepare the display data for displaying comparison the current usage with the target value in the comparison period.

6. The energy usage display unit according to claim 2, further comprising:

a past comparison display selecting section for selecting a comparison display between a current usage and a past usage in a comparison period, wherein the display control section controls such that the count value of the counting section and the stored value of the memory section are read out and added to prepare the display data for displaying comparison the current usage with the past usage in the comparison period.

7. The energy usage display unit according to claim 2, further comprising:

target value setting means for setting a target value, and a target value comparison display selecting section for selecting a comparison display between a current usage and the target value in a comparison period, wherein the display control section controls such that the count value of the counting section, or the count value of the counting section and the stored value of the memory section are read out and added to prepare the display data for displaying comparison the current usage with the target value in the comparison period.

8. The energy usage display unit according to claim 2, further comprising a list display selecting section for selecting a list display of usage, wherein the display control section controls such that the count value of the counting section and the stored value of the memory section are read and added to prepare the display data for displaying a current usage with a fixed time unit in chronological order.

* * * * *